United States Patent [19]

Lawson

[11] 4,108,049

[45] Aug. 22, 1978

[54] VARIABLE TORQUE FLUID DEVICE

[76] Inventor: Joseph M. Lawson, P.O. Box 518, Natchez, Miss. 39102

[21] Appl. No.: 701,360

[22] Filed: Jun. 30, 1976

Related U.S. Application Data

[63] Continuation-in-part of Ser. No. 570,187, Apr. 21, 1975, abandoned.

[51] Int. Cl.[2] ..... F01B 13/04

[52] U.S. Cl. ..... 91/478

[58] Field of Search ..... 91/478, 480, 482, 187; 417/269

[56] References Cited

U.S. PATENT DOCUMENTS

| | | | |
|---|---|---|---|
| 748,083 | 12/1903 | Lemp et al. | 91/478 |
| 751,924 | 2/1904 | Relly | 91/478 |
| 832,830 | 10/1906 | Witham | 91/478 |
| 2,088,582 | 8/1937 | Bishop | 91/481 |
| 2,391,575 | 12/1945 | Huber | 91/480 |
| 2,844,002 | 7/1958 | Pavesi | 91/480 |
| 3,426,523 | 2/1969 | Straub | 91/187 |
| 3,741,076 | 6/1973 | Tulp | 91/501 |
| 3,757,647 | 9/1973 | Abramopaulos | 91/482 |
| 4,041,843 | 8/1977 | Mischenko | 91/499 |

FOREIGN PATENT DOCUMENTS

| | | | |
|---|---|---|---|
| 180,090 | 4/1966 | U.S.S.R. | 417/269 |

*Primary Examiner*—William L. Freeh

[57] ABSTRACT

A variable displacement device for converting fluid power into shaft power and vice versa. The fluid displacement device includes a body having a plurality of chambers and having ports for allowing fluid to be received in and expelled from the plurality of chambers. Plungers are associated with the plurality of chambers in a manner so as to vary the displacement volume of the plurality of chambers. A shaft is associated with the plungers for rotation in unison with the movement of the plungers. Valves are associated with the plurality of chambers for selectively allowing fluid to flow between a first port and at least one of the plurality of chambers and between a second port and at least one of the plurality of chambers. An actuating mechanism is provided for selectively moving the valves between a first position in which fluid is allowed to flow between the first port and at least one of the plurality of chambers and a second position in which fluid is allowed to flow between the second port and at least one of the plurality of chambers.

3 Claims, 12 Drawing Figures

FLUID PRESSURE GENERATOR / ACCUMULATOR MEANS
FLUID RESERVOIR

VARIABLE TORQUE FLUID DEVICE

CROSS-REFERENCE TO RELATED APPLICATION

This is a continuation-in-part of my application, Ser. No. 570,187, filed Apr. 21, 1975, entitled "Variable Torque Fluid Motor", now abandoned.

BACKGROUND OF THE INVENTION

1. Field of the Invention

This invention relates generally to devices for converting power from one form to another and more specifically to fluid devices for converting fluid power to shaft power and vice versa.

2. Description of the Prior Art

Heretofore, various fluid devices have been developed for converting fluid power into shaft power and vice versa. These prior fluid devices are of two types, fixed displacement and variable displacement. In a conventional fixed displacement fluid device, the power output in terms of torque and speed is a function of the power input in terms of operating pressure and flow rate. The output speed is proportional to the volumetric input. The output torque is dependent upon the pressure input. The ratio between the output speed and output torque is dependent upon the displacement.

In a conventional variable displacement fluid device, the construction permits the working relation of the internal parts to be varied so as to vary displacement. The variation of the working relations, such as changing the angular relation between the swash plate and the cylinder block changes the displacement by varying the piston stroke or the like. Therefore, when displacement is increased to increase the work potential (torque) with input flow and pressure remaining constant, output speed is proportionally reduced and efficiency increased. When displacement is decreased to increase the output speed with input flow and pressure remaining constant, work potential (torque) is proportionally reduced and efficiency is decreased. Since the highest swash plate angle with the longest piston stroke for a given displacement volume will provide maximum mechanical advantage and higher operating efficiency, varying the swash plate angle and the piston stroke will vary the power output in terms of torque and speed at a sacrifice of efficiency except when operating at a maximum swash plate angle.

Pavesi, U.S. Pat. No. 2,844,002; Steward, U.S. Pat. No. 2,997,956; Stein, U.S. Pat. No. 3,450,058; Tulp, U.S. Pat. No. 3,741,076; Abramopaulos, U.S. Pat. No. 3,757,647; and D'Yachkov, Russian Pat. No. 224,312 relate to fluid devices of the same general type as the present invention. None of the above patents disclose or suggest the present invention.

SUMMARY OF THE INVENTION

The present invention is directed towards overcoming the problems and disadvantages of prior fluid displacement devices. The fluid displacement device of the present invention includes a body means having a plurality of chambers and having first and second ports for allowing a fluid to be received in and expelled from the plurality of chambers. Movable means such as pistons or plungers are associated with the plurality of chambers in such a manner as to vary the displacement volume of the plurality of chambers. A shaft means is associated with the movable means for rotation in unison with the movement thereof. A fluid distribution means is provided for controlling fluid flow between the plurality of chambers and the first and second ports of the body means. The fluid distribution means includes valve means associated with the plurality of chambers for movement between a first position in which fluid is allowed to flow between the first port and at least one of the plurality of chambers and a second position in which fluid is allowed to flow between the second port and at least one of the plurality of chambers. The fluid distribution means includes actuating means for moving the valve means between the first and second positions.

DESCRIPTION OF THE PREFERRED EMBODIMENT

Figure 1:
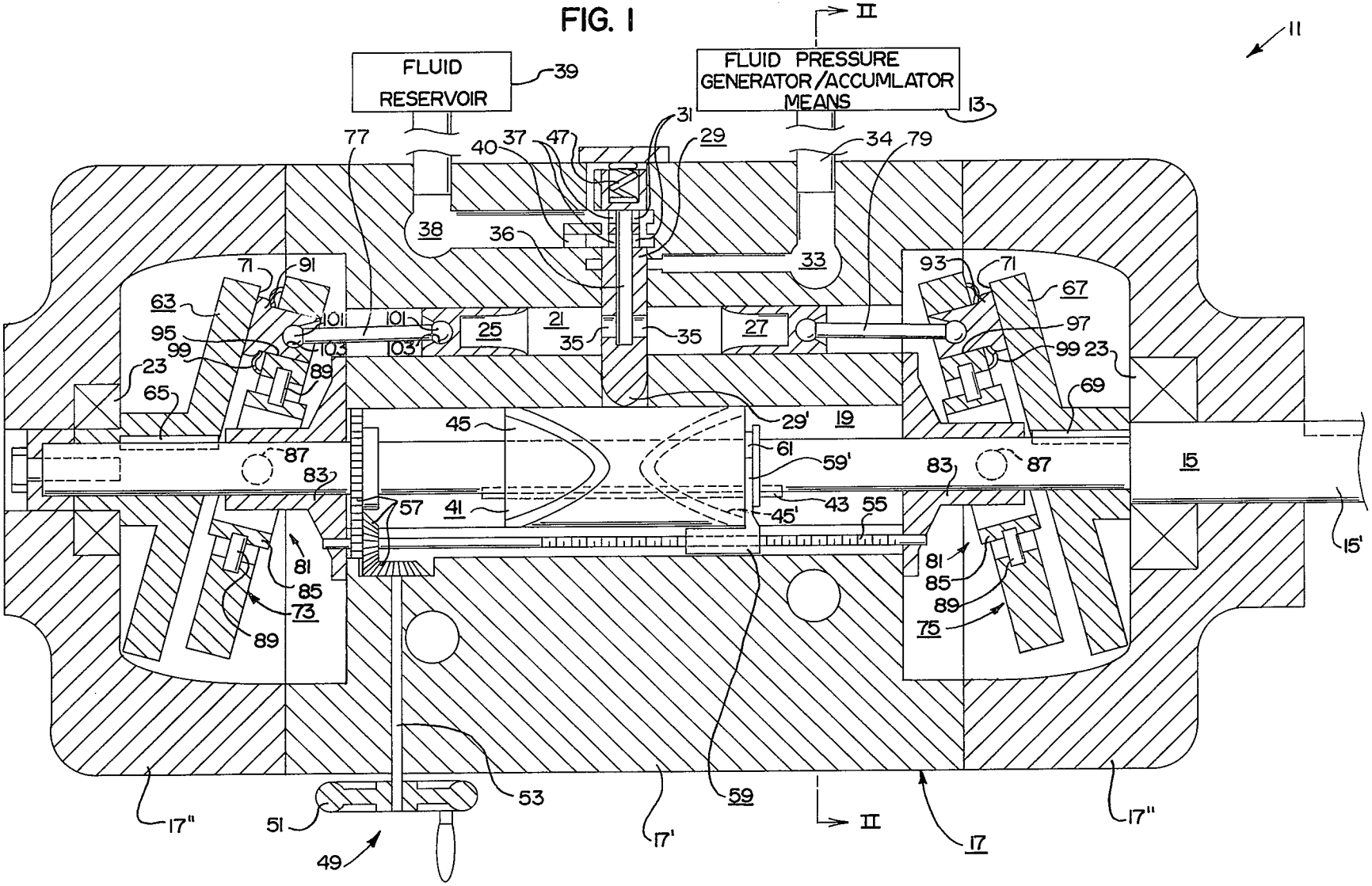
FIG. 1 is a sectional view of the fluid device means of the present invention shown diagrammatically attached to a fluid pressure generator/accumulator means.
Figure 2:
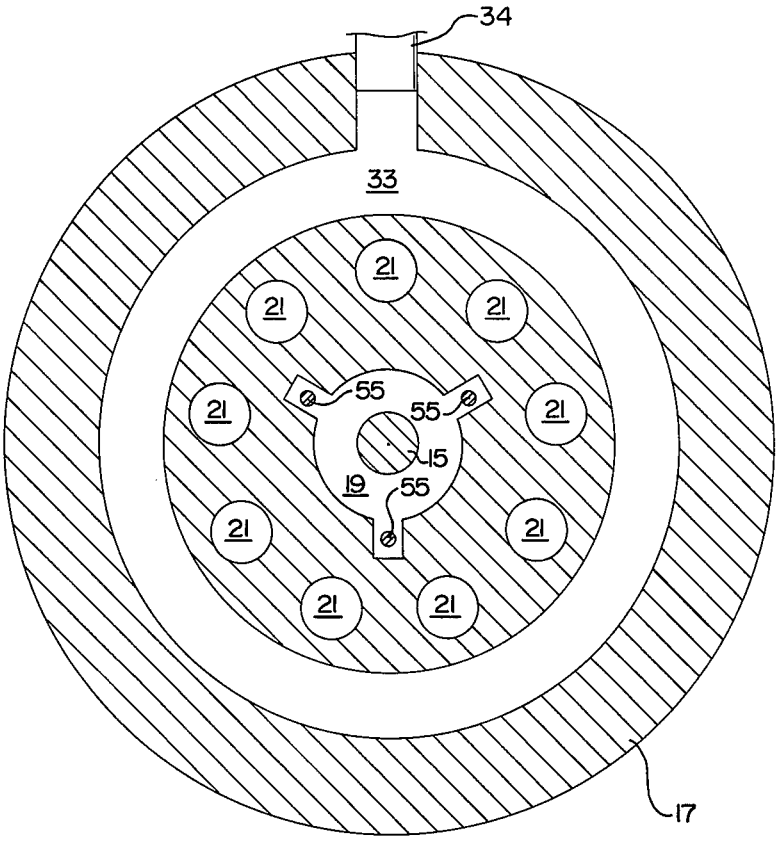
FIG. 2 is a sectional view of the fluid device means of the present invention as taken on line II—II of FIG. 1.
Figure 3:
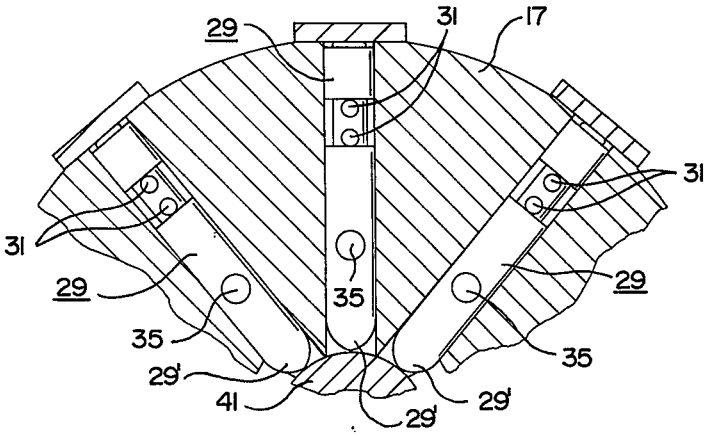
FIG. 3 is a sectional view of a portion of the fluid device means of the present invention.

The fluid displacement device means of the present invention is for use in converting fluid power into shaft power and vice versa. More specifically, the fluid device means of the present invention when used to convert fluid power into shaft power receives fluid power from any well-known fluid pressure generator/accumulator means and uses this fluid power to cause a shaft means to rotate. The shaft means of the fluid motor means may be attached to any means which requires shaft power to operate such as the differential of an automobile (not shown). When the fluid device means is used to convert shaft power into fluid power, a typical power means such as an electric motor (not shown) is attached to the shaft means to cause rotation thereof for allowing fluid to be pumped from a fluid reservoir 39.

A first embodiment of the fluid device means of the present invention is shown in FIGS. 1–7 and is identified by the numeral 11. The fluid device means 11 is for use with a fluid pressure generator/accumulator 13 and includes a shaft means 15 for attachment to any means which requires shaft power to operate such as the differential of an automobile or to any typical power means such as an electric motor.

The fluid device means 11 includes a body means 17 including a midportion 17' and end portions 17''. A central bore 19 and a plurality of axially aligned displacement chambers or bores 21 arranged parallel to and spaced radially from the central bore 19 are preferably provided in the body means 17. The body means 15 includes first and second ports or passageways 33, 38 for allowing fluid to be introduced into and expelled from the bores 21. The shaft means 15 is rotatably mounted in the central bore 19 by way of bearings 23 or the like. At least one end 15' of the shaft means 15 extends from the body means 17 to allow the shaft means 15 to be attached to a differential of an automobile or the like.

The fluid device means 11 also includes movable means operably coupled with the shaft means 15 such as a plurality of piston means with each of the plurality of piston means being movably mounted in respective ones of the plurality of axially aligned bores 21 of the body means 17 for selectively increasing or decreasing the displacement volume of the bores 21. Preferably, each of the plurality of piston means includes first and second opposed piston members 25, 27 slidably mounted in each of the plurality of axially aligned bores 21 of the body means 17.

Figure 4:
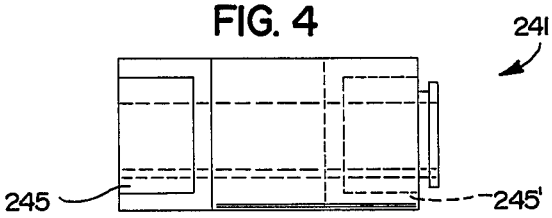
FIG. 4 is an elevational view of an alternate embodiment of a portion of the fluid device means of the present invention.
Figures 5, 6, 7:
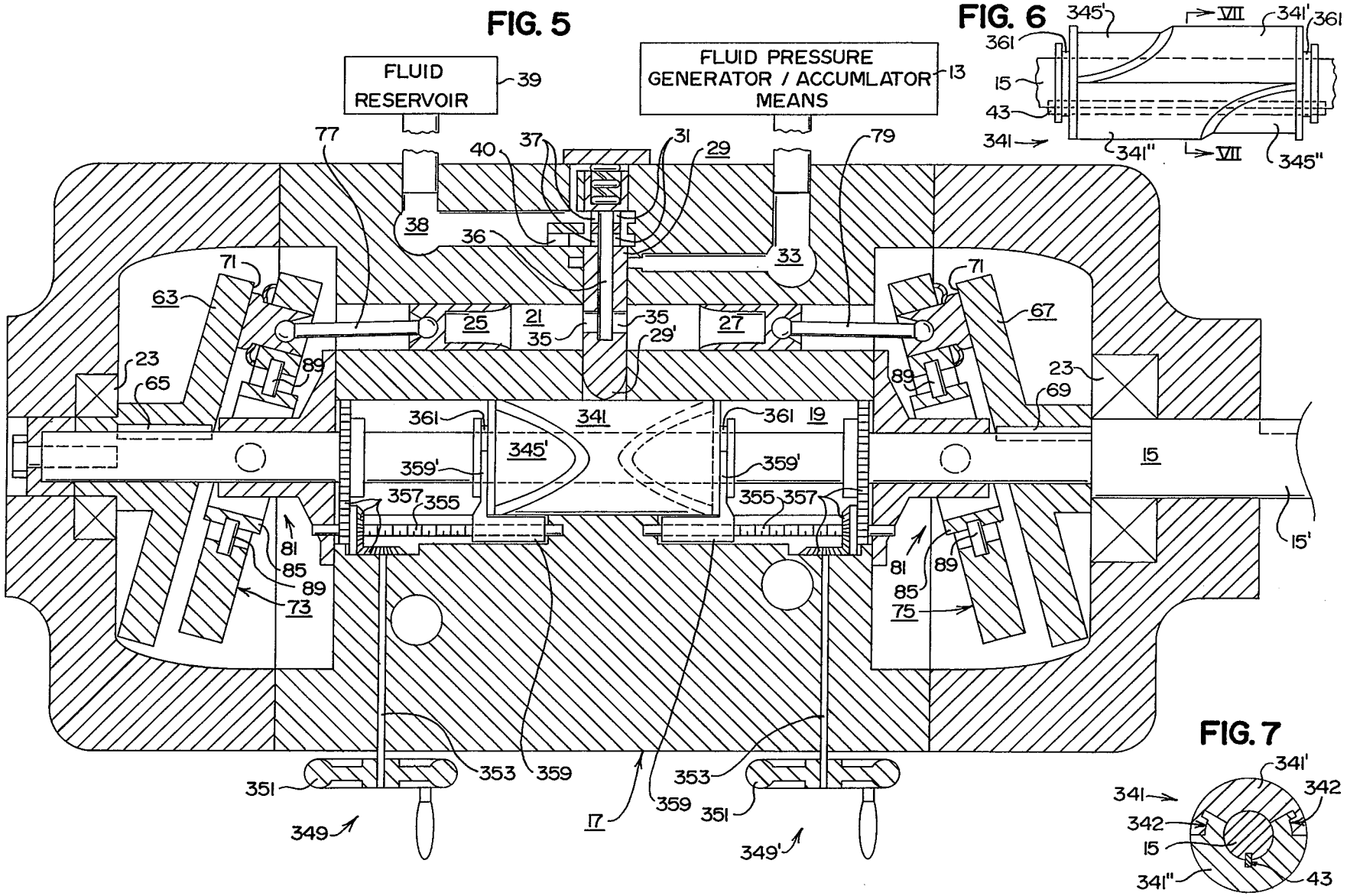
FIG. 5 is a sectional view of the fluid device means of the present invention substantially similar to FIG. 1 but showing an alternate embodiment of the means for selectively supplying fluid power to selective ones of the axially aligned bores of the body means.
FIG. 6 is a top plan view of a two-piece cylindrical cam of the means for selectively supplying fluid power to selective ones of the axially aligned bores of the body means of FIG. 5.
FIG. 7 is a cross-sectional view of the two-piece cam means of FIG. 6 as taken on line VII—VII of FIG. 6.
Figure 8:
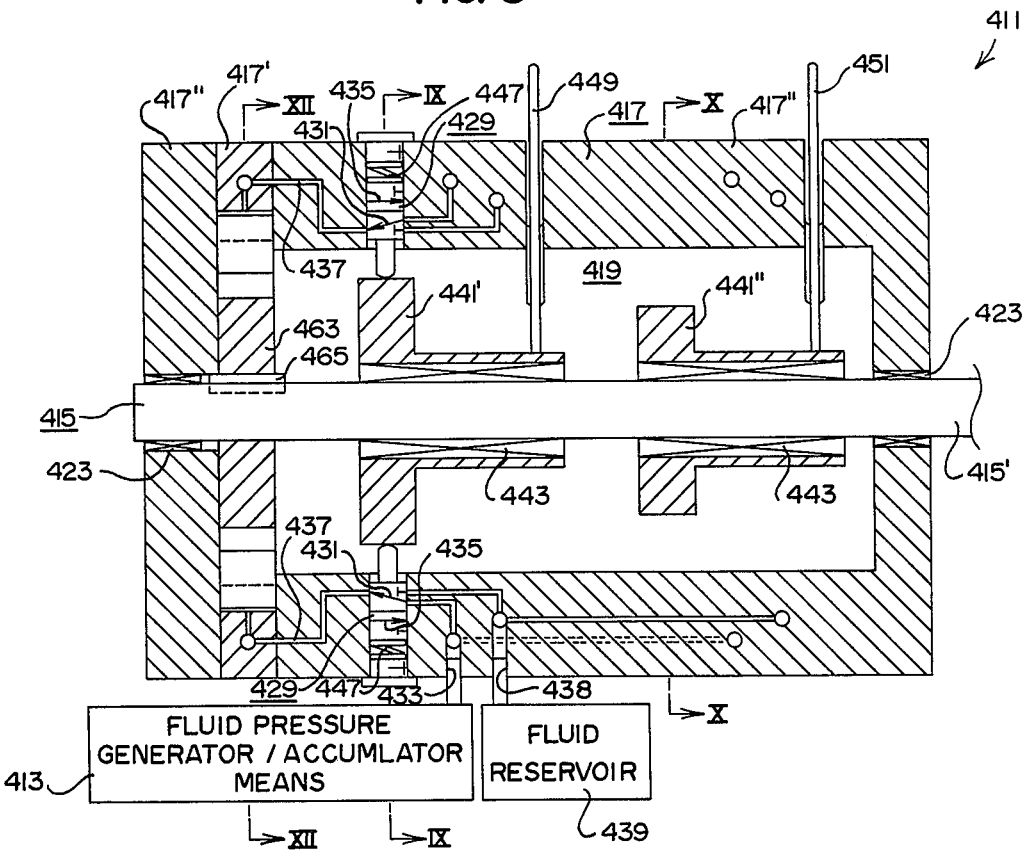
FIG. 8 is a sectional view of an alternate embodiment of the fluid device means of the present invention with some portions thereof omitted for the sake of clarity and with some parts thereof shown schematically.

The fluid device means 11 includes a fluid distribution means such as means for selectively supplying fluid power to selective ones of the plurality of axially aligned bores 21 of the body means 17 to cause the first and second piston members 25, 27 to slide back and forth in the axially aligned bores 21. The means for selectively supplying fluid power to selective ones of the axially aligned bores 21 includes a plurality of valve means 29. Each of the valve means 29 is adapted for movement between a first position in which fluid is allowed to flow between the passageway 33 and an associated bore 21, and a second position in which fluid is allowed to flow between the passageway 38 and an associated bore 21. More specifically, each valve means 29 includes a first port 31 for selective communication with the fluid pressure generator/accumulator means 13 through the passageway 33 in the body means 17 and a line 34 leading from the passageway 33 to the fluid pressure generator/accumulator means 13, and includes a second port 35 for communication with the respective axially aligned bore 21 intermediate the first and second piston members 25, 27. In addition, each valve means 29 includes a passageway 36 between the first port 31 and second port 35. In addition, each valve means 29 preferably includes a port 37 for communication with the passageway 38 to allow fluid flow between the fluid reservoir 39 and each bore 21 when the valve means 29 is in the second position. The passageway 38 is preferably provided with a check valve 40 adjacent each port 37 to allow replacement fluid flow from the reservoir 39 to each bore 21 when the valve means 29 is in the first position to prevent cavitation in the bores 21 while preventing any fluid flow from the bores 21 to the fluid reservoir 39. Thus, when a valve means 29 is in the first position, the port 31 is aligned with the passageway 33 to allow fluid power to pass from the fluid pressure generator/accumulator means 13 through the line 34, passageway 33, port 31, passageway 36 and port 35 into the axially aligned bore 21 thereby causing the first and second piston members 25, 27 to slide back and forth in the axially aligned bores 21. Thus, when the valve means 29 is in the first position, fluid is allowed to flow between the passageway 33 and the bores 21 while being prevented from flowing from the bores 21 to the passageway 38. Also, when the valve means 29 is in the second position, fluid is allowed to flow between the passageway 38 and the bores 21 while being prevented from flowing between the passageway 33 and the bores 21. The means for selectively supplying fluid power to selective ones of the axially aligned bores 21 preferably includes actuating means such as cam means 41 for moving each of the plurality of valve means 29 between the first and second positions. The cam means 41 is attached to the shaft means 15 by a key 43 or the like for rotation therewith to move the plurality of valve means 29 between the first and second positions responsive to the rotation of the shaft means 15. The cam means 41 includes at least one recessed portion 45. The end 29' of each valve means 29 acts as a cam follower and is held against the cam means 41 by a spring 47 or the like. Thus, when the recessed portion 45 of the cam means 41 is adjacent the end 29' of a valve means 29, the valve means 29 will be in the first position allowing fluid power to enter the axially aligned bore 21. Contra, when the end 29' of a valve means 29 is not adjacent the recessed portion 45 of the cam means 41, the valve means 29 will be in the second position preventing fluid power from entering the axially aligned bore 21. Preferably, the cam means 41 includes a recessed portion 45, 45' on each end thereof located 180° apart. The midportion of the cam means 41 is not recessed. Each recessed portion 45, 45' preferably covers 180° of the cam means 41 adjacent the ends thereof and tapers to 0° before reaching the midportion of the cam means 41. The means for selectively supplying fluid power to selective ones of the axially aligned bores 21 may include means for varying the movement of the valve means 29 in response to the rotation of the shaft means 15. More specifically, the cam means 41 is preferably laterally movable on the shaft means 15 to cause the movement of the valve means 29 in response to the rotation of the shaft means 15 to be varied. That is, as the cam means 41 is laterally moved on the shaft means 15, the recessed portions 45, 45' of the cam means 41 are moved relative to the ends 29' of the plurality of valve means 29 thereby varying the period of time the valve means 29 are in the first position as the shaft means 15 rotates. Manual means 49 is preferably provided for laterally moving the cam means 41 on the shaft means 15. The manual means 49 may be of any construction well known to those skilled in the art. Preferably, the manual means 49 includes a handle 51, a shaft 53 fixedly attached to the handle 51 and rotatably mounted in the body means 17, a plurality of threaded rod members 55 rotatably mounted in the body means 17 adjacent to and parallel the shaft means 15 and cam means 41, gear members 57 for transferring rotation from the shaft 53 to the plurality of threaded rod members 55, and a drive member 59 threadingly received on each of the plurality of threaded rod members 55 for movement thereon as the threaded rod members 55 rotate. Each drive member 59 includes a projecting portion 59' that is received in a groove 61 in the cam means 41 to drive the cam means 41 back and forth on the shaft means 15 as the drive members 59 move back and forth on the threaded rod members 55 and the threaded rod members 55 rotate. To reverse the rotation of the shaft means 15 or use hydraulic braking, the cam means 41 is moved to the left so that recessed portion 45' activates the valve means 29 in the same manner as recessed portion 45 but at 180°. Other surface configurations of the cam means 41 are possible. One is shown in FIG. 4. In this embodiment, the cam means 241 includes recessed portions 245, 245' located at either end thereof. The recessed portions 245, 245' do not taper inwardly the midportion of the cam means 241 as do the recessed portions 45, 45' of the cam means 41 but maintain a substantially constant recessed portion (e.g., 180°) from the midportion of the cam means 241 to the outer ends thereof. When the cam means 241 is used, the valve means 29 should be staggered in pairs 180° apart. The torque would then be increased or decreased in steps as each pair entered or left the recessed area. This and other configurations will permit designing for special purposes. Another embodiment of the cam means is shown in FIGS. 5, 6 and 7. In this embodiment, the cam means 341 is split into two pieces 341', 341" with each piece 341', 341" laterally movable on the shaft means 15 independently of one another. The cam means 341 may include tongue-and-groove means 342 (see FIG. 7) for allowing the pieces 341', 341" to slide relative to one another while remaining attached to one another in a manner well known to those skilled in the art. Two manual means 349', 349" are provided in this embodiment for laterally moving each piece 341', 341" of the cam means 341 on the shaft means 15. Each manual means 349', 349" is substantially identical to one another and is similar in construction to the manual means 49 heretofore discussed. More specifically, each manual means 349', 349" may include a handle 351, a shaft 353 fixedly attached to the handle 351 and rotatably mounted in the body means 17, a plurality of threaded rod members 355 (only one being shown) rotatably mounted in the body means 17 adjacent to and parallel the shaft means 15 and cam means 341, gear members 357 for transferring rotation from the shaft 353 to the plurality of threaded rod members 355, and a drive member 359 threadingly received on each of the plurality of threaded rod members 355 for movement thereon as the threaded rod members 355 rotate. Each drive member 359 includes a projecting portion 359' that is received in a groove 361 in the cam means 341 to drive each respective piece 341', 341" of the cam means 341 back and forth on the shaft means 15 as the drive members 359 move back and forth on the threaded rod members 355 and the threaded rod members 355 rotate. The piece 341' of the cam means 341 includes a recessed portion 354' and the piece 341" of the cam means 341 includes a recessed portion 345". The recessed portions 354', 345" are substantially similar to the recessed portion 45, 45' of the cam means 41. That is, each recessed portion 345', 345" preferably covers 180° of the cam means 341 adjacent the ends thereof and tapers to 0° before reaching the midportion of the specific piece 341', 341" of the cam means 341. By so splitting the cam means 341 into the two pieces 341', 341", infinite adjustment of the introduction of fluid into the axially aligned bores 21 is premitted. More specifically, when the cam means 341 is in the position shown in FIGS. 5 and 6, all the valve means 29 will be held in the second position so that no fluid will be allowed to flow into any of the axially aligned bores 21 from the fluid pressure generator/accumulator 13 and the shaft means 15 will be in a neutral, free-wheeling position. When the pieces 341', 341" of the cam means 341 are in the extreme outer position, all of the valve means 29 will be in the first position so that fluid will flow into all of the axially aligned bores 21 from the fluid pressure generator/accumulator 13 and the shaft means 15 will be in a neutral, hold position with the holding capacity, or energy loss, being equal to the frictional losses within the motor. When the pieces 341', 341" of the cam means 341 are in positions equal distance from the extreme outer positions thereof, certain valve means 29 that are 180° apart will be in the first position so that fluid will flow into certain axially aligned bores 21 that are 180° apart and the opposing pressure developed therebecause will cause the shaft means 15 to be in a neutral, hold position as discussed above. However, when the pieces 341', 341" are in positions that are unequally distant from the extreme outer positions, more value means 29 on one 180° portion of the shaft means 15 will be in the first position than on the opposite 180° portion thereof thereby causing the shaft means 15 to rotate in a certain direction. By varying the positions of the pieces 341', 341" of the cam means 341 relative to one another, infinite and smooth variances in the amount of torque produced by the shaft means 15 can be obtained.

The fluid device means 11 includes swash plate means attached to the shaft means 15. Preferably, the swash plate means includes a first swash plate member 63 attached to the shaft means 15 adjacent one end of the axially aligned bores 21 of the body means 17 by a key 65 and includes a second swash plate member 67 attached to the shaft means 15 adjacent the other end of the axially aligned bores 21 by a key 69. Each of the swash plate members 63, 65 have a face surface 71. The first and second swash plate members 63, 67 are attached to the shaft means 15 with the face surfaces 71 thereof positioned at an angle to the shaft means 15. Although the face surfaces 71 may be positioned at any angle to the shaft means 15, preferably the swash plate members 63, 67 are attached to the shaft means 15 with the face surfaces 71 set at the angle, well known to those skilled in the art, that will give maximum mechanical efficiency to the fluid device means 11.

The fluid device means 11 includes means for mechanically associating the plurality of piston means and the swash plate means to cause rotation of the swash plate means as the plurality of piston means slide back and forth in the axially algined bores 21 of the body means 17. The means for mechanically associating the plurality of piston means and the swash plate means preferably includes follow plate means and a plurality of connecting rod means for connecting the plurality of piston means and the follow plate means. The follow plate means preferably includes a first follow plate member 73 positioned adjacent and adapted to remain substantially parallel to the first swash plate member 63 and includes a second follow plate member 75 positioned adjacent and adapted to remain substantially parallel to the second swash plate member 67. Each connecting rod means preferably includes a first connecting rod member 77 for connecting the first piston member 25 and the first follow plate member 73 and includes a second connecting rod member 79 for connecting the second piston member 27 and the second follow plate member 75. Each of the first and second follow plate members 73, 75 are attached to the body means 17 adjacent the first and second swash plate members 63, 67 respectively by a gimbal mount 81 or the like. The gimbal mount 81 preferably includes a first member 83 fixedly attached to the body means 17 and a second member 85 pivotally attached to the first member 83 by pivots 87. The follow plate 73 is preferably pivotally attached to the second member 85 of the gimbal mount 81 by pivots 89. Preferably, the means for mechanically associating the plurality of piston means and the swash plate means includes a plurality of shoe means for slidably engaging the swash plate means. Each of the plurality of shoe means preferably includes a first shoe member 91 for slidably engaging the first swash plate member 63 and includes a second shoe member 93 for slidably engaging the second swash plate member 67. The first shoe member 91 is slidably mounted to the first follow plate member 73 by way of an aperture 95 in the first follow plate member 73. Likewise, the second shoe member 93 is slidably mounted to the second follow plate member 75 by way of an aperture 97 in the second follow plate member 75. A spring member 99 is provided between each of the shoe members 91, 93 and the respective follow plate members 73, 75 to force the shoe members 91, 93 to slidably engage the swash plate members 63, 67. The first and second connecting rod member 77, 79 are preferably movably mounted to the respective first and second piston members 25, 27 and the respective first and second shoe members 91, 93. More specifically, the ends of the first and second connecting rod members 77, 79 are preferably provided with ball members 101 for coacting in socket members 103 provided in the piston members 25, 27 and shoe members 91, 93 thereby providing a universal joint between the connecting rod members 77, 79 and the piston members 25, 27 and the shoe members 91, 93.

The operation of the fluid device means 11 is quite simple. When the fluid device means 11 is used to convert fluid power into shaft power and when one of the valve means 29 is in the first position, fluid power will pass from the fluid pressure generator/accumulator 13 into the respective axially aligned bore 21 forcing the first and second piston members 25, 27 of that axially aligned bore 21 outward thereby causing the swash plate members 63, 67 and the shaft means 15 to rotate in a manner well known to those skilled in the art. As the shaft means 15 rotates, other valve means 29 are moved to the first position to cause the shaft means 15 to continue rotation. By laterally moving the cam means 41, the torque produced by the shaft means 15 can be varied.

When the fluid device means 11 is used to convert shaft power into fluid power and when the shaft means 15 is rotated by a power means such as an electric motor (not shown) and when at least one of the valve means 29 is in the first position, the swash plate members 63, 67 will rotate thereby causing the first and second piston members 25, 27 to slide back and forth within the axially aligned bores 21. As the piston members 25, 27 slide back and forth, fluid will be pumped from the fluid reservoir 39 to the fluid pressure generator/accumulator means 13.

A second embodiment of the fluid device means of the present invention is shown in FIGS. 8–12 and is identified by the numeral 411. The fluid device means 411 is for use with a fluid pressure generator/accumulator 413 and includes a shaft means 415 for attachment to any means which requires shaft power to operate such as the differential of an automobile or to any typical power means such as an electric motor.

The fluid device means 411 includes a body means 417. The body means 417 may include a midportion 417' and a pair of end portions 417" sandwiching the midportion 417" therebetween. Bolts 418 or the like (see FIGS. 9, 10, and 12) may be provided to fixedly attach the midportion 417' and end portions 417" together. The body means 417 preferably includes a central bore 419 for reasons which will hereinafter become apparent. The body means 417 includes a plurality of chambers 421 (see FIG. 12) arranged in the central bore 419 in a manner which will hereinafter become apparent. The shaft means 415 is rotatably mounted in the central bore 419 on bearings 423 or the like. At least one end 415' of the shaft means 415 extends from the body means 417 to allow the shaft means 415 to be attached to a differential of an automobile or an electric motor or the like. Port means 433 is provided in the body means 417 to allow fluid to selectively pass between the fluid pressure generator/accumulator 413 and the plurality of chambers 421. Likewise, port means 438 is provided in the body means 417 to allow fluid to selectively pass between a fluid reservoir 439 and the plurality of chambers 421.

Figure 12:
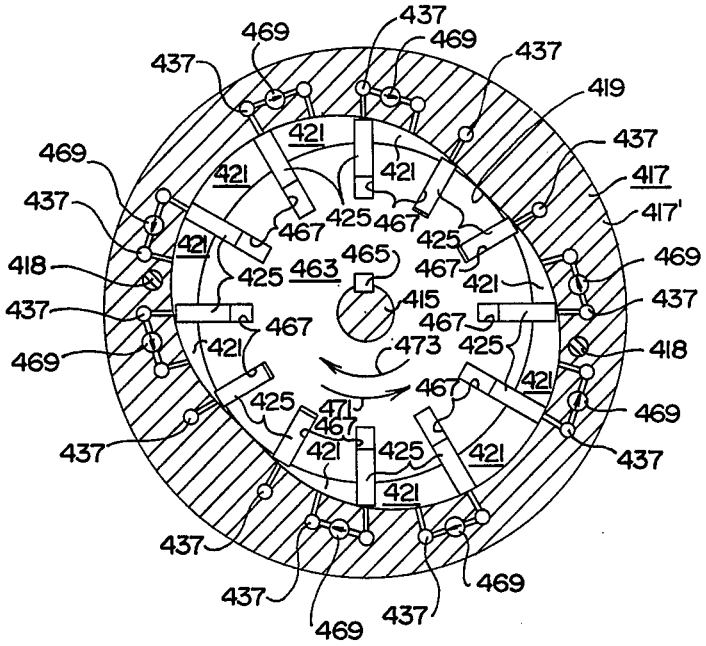
FIG. 12 is a sectional view of the alternate embodiment of the fluid device means of the present invention as taken on line XII—XII of FIG. 8.

The fluid device means 411 also includes movable means operably coupled with the shaft means 415 such as a plurality of plungers or vanes 425 (see FIG. 12). The vanes 425 are associated with the chambers 421 in such a manner as to vary the displacement volume of the chambers 421 as will hereinafter become apparent.

The fluid device means 411 also includes a fluid distribution means such as means for selectively supplying fluid power to selective ones of the plurality of chambers 421 to control the flow of fluid between the plurality of chambers 421 and the port means 433, 438. The fluid distribution means includes valve means 429 associated with the plurality of chambers 421. Preferably, the fluid device means 411 includes a plurality of the valve means 429. Each of the valve means 429 is adapted for movement between a first position in which fluid is allowed to flow between one of the port means 433, 438 and an associated chamber 421, and a second position in which fluid is allowed to flow between the other of the port means 433, 438 and an associated chamber 421. More specifically, each valve means 429 includes a first passageway 431 for allowing fluid to flow between the fluid pressure generator/accumulator 413 and an associated chamber 421 through the port means 433, and includes a second passageway 435 for allowing fluid to flow between the fluid reservoir 439 and an associated chamber 421 through the port means 438 (see FIGS. 8 and 11). The valve means 429 are preferably constructed in any well known manner that should be apparent to those skilled in the art. Passageways 437 are provided between each valve means 429 and the chambers 421 for allowing fluid to flow therebetween.

The fluid distribution means includes actuating means for moving the valve means 429 between the first and second positions. The actuating means preferably includes a first cam means 441' for moving half the valve means 429 between the first and second positions. Also, the actuating means preferably includes a second cam means 441" for moving the other half of the valve means 429 between the first and second positions. The first and second cam means 441', 441" may be rotatably mounted to the shaft means 415 by way of bearings 433 or the like. The first cam means 441' is manually movable from the position shown in solid line in FIG. 9 to the position shown in broken lines in FIG. 9 by a handle 449 attached thereto in a manner which is apparent to those skilled in the art. When the cam means 441' is so moved from the position shown in solid lines in FIG. 9 to the position shown in broken lines in FIG. 9, the valve means 429 which coact with the first cam means 441' will be moved from the first position to the second position. The second cam means 441" is likewise preferably manually movable from the position shown in solid lines in FIG. 10 to the position shown in broken lines in FIG. 10 by a handle 451 attached thereto in a manner which should be apparent to those skilled in the art. When the second cam means 441" is so moved from the position shown in solid lines in FIG. 10 to the position shown in broken lines in FIG. 10, the valve means 329 which coact with the cam means 441" will be moved from the first position to the second position. Springs 447 are provided for holding the valve means 429 against the first and second cam means 441', 441".

The fluid device means 411 includes a rotor means 463 fixedly attached to the shaft means 415 by way of a key 465 or the like. The rotor means 463 is substantially identical with a rotor means of a typical vane pump or motor and of a construction that is apparent to those skilled in the art. The vanes 425 are slidably mounted in radially located slots 467 in the rotor means 463 in a manner identical to that of a typical vane pump or motor. The midportion 417' of the body means 417 is constructed so as to act as a cam ring for the rotor means 463 and vanes 425 in a manner that is apparent to these skilled in the art. More specifically, the rotor means 463, vanes 425 and midportion 417' of the body means 417 coact togather as a typical vane pump or motor. Check valves 469 are preferably provided in selected parts of the passageway 437 in the midportion 417' of the body means 417 for reasons which will hereinafter become apparent.

The operation of the fluid device means 411 as a motor is quite simple. When the first cam means 441' is in the position shown in solid lines in FIG. 9 and the second cam means 441" is in the position shown in solid lines in FIG. 10, fluid will flow from the fluid pressure generator/accumulator means 413 to various chambers 421 through the port means 433, through the passageways 431 in the valve means 429 that coact with the first cam means 441' (see FIG. 9) through the passageways 437, and into various chambers 421 thereby causing the rotor means 463 and the shaft 415 to rotate in a counterclockwise direction as indicated by the arrow 471 in FIG. 12. As the rotor means 463 and shaft means 415 rotate, the fluid will be forced from the chambers 421 through the passageways 437, through the passageways 435 in the valve means 429 that coact with the second cam means 441", and through the port means 438, and into the fluid reservoir 439.

Figure 9:
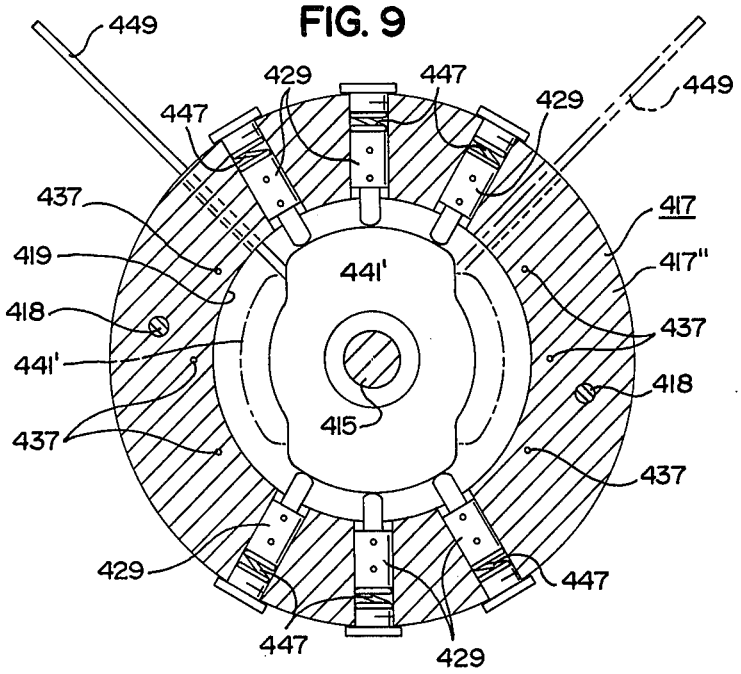
FIG. 9 is a sectional view of the alternate embodiment of the fluid device means of the present invention as taken on line IX—IX of FIG. 8.
Figure 10:
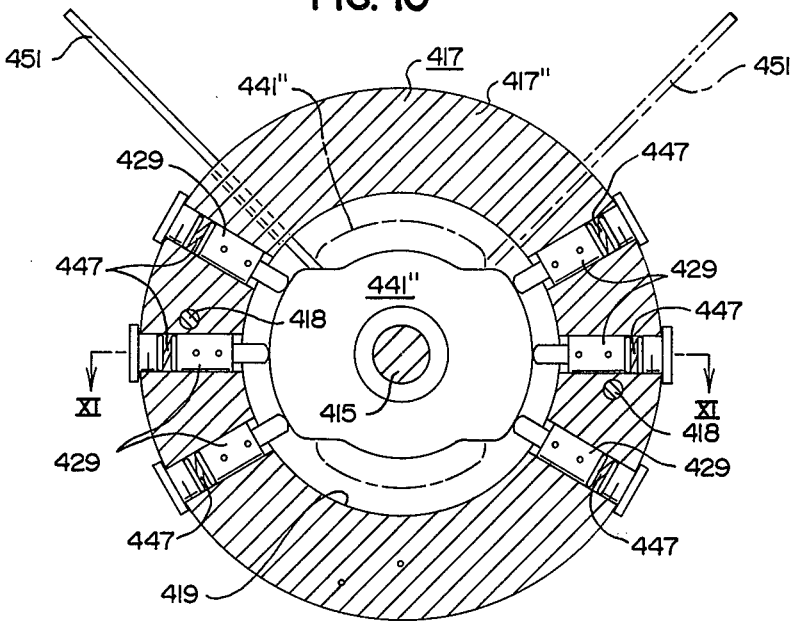
FIG. 10 is a sectional view of the alternate embodiment of the fluid device means of the present invention as taken on line X—X of FIG. 8.
Figure 11:
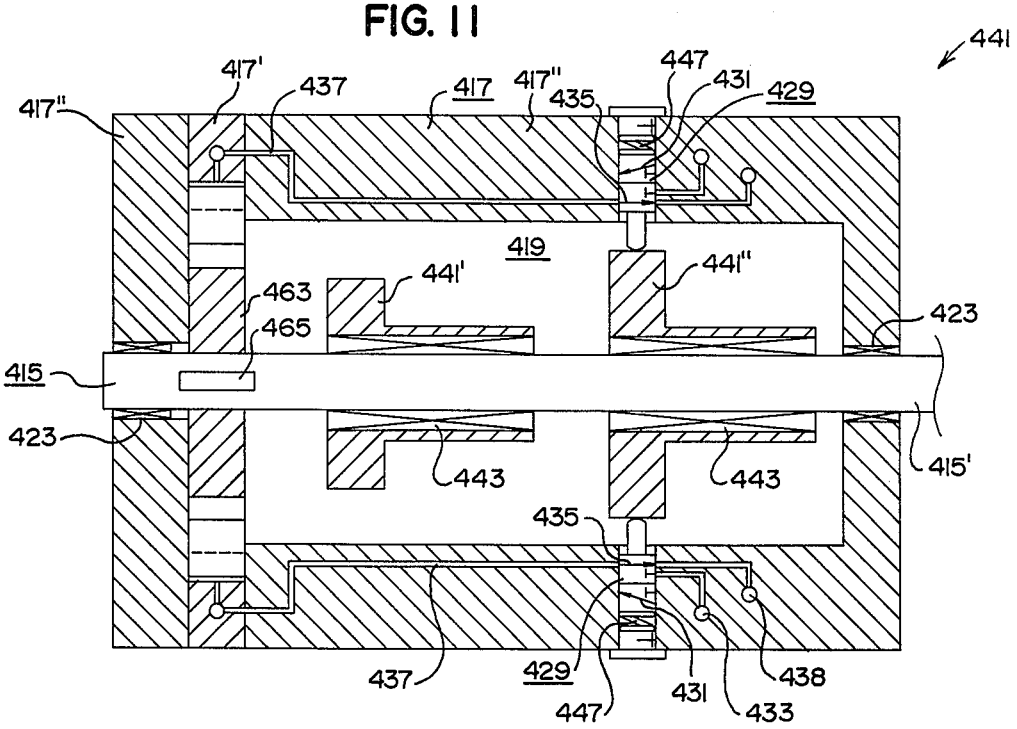
FIG. 11 is a sectional view of the alternate embodiment of the fluid device means of the present invention as taken on line XI—XI of FIG. 10.

When the first cam means 441' is in the position shown in broken lines in FIG. 9 and the second cam means 441" is in the position shown in broken lines in FIG. 10, fluid will flow from the fluid pressure generator/accumulator means 413 to various chambers 421 through the port means 433, through the passageways 431 in the valve means 429 that coact with the second cam means 441" (see FIG. 10), through the passageways 437, and into various chambers 421 thereby causing the rotor means 463 and the shaft 415 to rotate in a clockwise direction as indicated by the arrow 473 in FIG. 12. As the rotor means 463 and shaft means 415 rotate, the fluid will be forced from the chambers 421 through the passageways 435, through the passageways 435 in the valve means 429 that coact with the first cam means 441", through the port means 438, and into the fluid reservoir 439.

To use the fluid device means 411 as a pump, an electric motor or the like (not shown), is attached to the end 415' of the shaft means 415 so as to rotate the rotor means 463. As the rotor means 463 is so rotated, fluid will be drawn into the chambers 421 from the fluid reservoir 439 through the port means 438, through the passageways 435 in various ones of the valve means 429, and through various ones of the passageways 437 and will be, in turn, forced from the chambers 421 through others of the passageways 437, through the passageway 431 in various ones of the valve means 329 depending on the positions of the first and second cam means 441', 441", through the port means 433, and into the fluid pressure generator/accumulator means 413.

Although the invention has been described and illustrated with respect to a preferred embodiment thereof, it is not to be so limited since changes and modifications may be made therein which are within the full intended scope of the invention.

I claim:

1. A fluid displacement device comprising:

(a) body means having a plurality of chambers and having first and second port means for allowing a fluid to be introduced into and expelled from said plurality of chambers;

(b) movable means associated with said plurality of chambers for increasing and decreasing the displacement volume of said plurality of chambers;

(c) shaft means operably coupled with said movable means, (d) fluid distribution means for controlling fluid flow between said plurality of chambers and said first and second port means of said body means, said fluid distribution means including valve means associated with each of said plurality of chambers for movement between a first position allowing fluid to flow between said first port means and at least one of said plurality of chambers and a second position allowing fluid to flow between said second port means and at least one of said plurality of chambers, said fluid distribution means including actuating means for moving said valve means between the first and second positions, said actuating means including a single cam means attached to said shaft means for rotation therewith to move said valve means between the first and second positions responsive to the rotation of said shaft means, said cam means including an elongated cylinder having a first recessed portion on one end thereof and a second recessed portion on the other end thereof, said cam means being laterally movable on said shaft means, said cam means being composed of two separate pieces with one of said first and second recessed portions provided on each piece and with each piece adapted to selectively overlap a portion of the other and to be laterally movable on said shaft means independently of the other.

2. Variable torque fluid device for converting fluid power to shaft power, said fluid device comprising:

(a) body means, said body means including a central bore and a plurality of axially aligned bores arranged parallel to and spaced radially from said central bore;

(b) shaft means rotatably mounted in said central bore of said body menas, at least one end of said shaft means extending from said body means;

(c) plurality of piston means, each of said plurality of piston means being slidably mounted in respective ones of said axially aligned bores of said body means;

(d) swash plate means attached to said shaft means, said swash plate means having a face surface and being attached to said shaft means with said face surface positioned at an angle to said shaft means;

(e) means for mechanically associating said piston means and said swash plate means to cause rotation of said swash plate means as said piston means slide back and forth in said axially aligned bores of said body means;

(f) means for selectively supplying fluid to at least one of said axially aligned bores of said body means while said piston means slide back and forth from one extreme position to the other in said axially aligned bores, said means for selectively supplying fluid power to selective ones of said axially aligned bores including valve means for movement between a first position allowing fluid power to enter said axially aligned bores and a second position allowing only replacement fluid to enter said axially aligned bores and including cam means for moving said valve means between the first and second positions, said cam means being attached to said shaft means for rotation therewith to move said valve means between the first and second positions responsive to the rotation of said shaft means, said cam means being laterally movable on said shaft means to vary the movement of said valve means in response to the rotation of said shaft means, said cam means including an elongated cylinder having a first recessed portion on one end thereof and a second recessed portion on the other end thereof, said first and second recessed portions being located 180° apart for allowing the rotation of said shaft means to be selectively reversed, said cam means being composed of two separate pieces with one of said first and second recessed portions provided on each piece and with each piece adapted to be individually laterally movable on said shaft means independently of the other for infinitely varying the amount of torque produced by said shaft means; and (g) means for varying the ratio of replacement fluid and power fluid delivered to said axially aligned bores during any unidirectional stroke of said piston means.

3. An improved fluid distribution system for use in a fluid displacement device of the type including body means having a plurality of chambers and having first and second port means for allowing a fluid to be introduced into and expelled from said plurality of chambers, movable means associated with said plurality of chambers for increasing and decreasing the displacement volume of said plurality of chambers, and shaft means operably coupled with said movable means, said improved fluid distribution system comprising:

(a) a plurality of valve means, each of said plurality of valve means being associated with one of said plurality of chambers for movement between a first position establishing communicatin between said first port and the associated chamber establishing communication between said second port and the associated chamber and a second position; and (b) actuating means for moving said valve means between the first and second position, said actuating means including a cam means attached to said shaft means, said cam means consisting of an elongated cylinder, said cam means including a first recessed portion and a first elevated portion for causing movement of said valve means between said first and second positions, said cam means including a second recessed portion and a second elevated portion on the end thereof opposite said first recessed portion and said first elevated portion, said first and second recessed portions being located 180° apart, said cam means being composed of two separate pieces with one of said first and second recessed portions provided on each piece and with each piece adapted to be individually laterally movable on said shaft means independently of the other or infinitely varying the amount of fluid entering said plurality of chambers.

* * * * *